US011051572B2

(12) United States Patent
Klein

(10) Patent No.: US 11,051,572 B2
(45) Date of Patent: Jul. 6, 2021

(54) INFLATABLE SAFETY HELMET

(71) Applicant: Airnoggin, Inc., Paterson, NJ (US)

(72) Inventor: Jeffrey Klein, Hackensack, NJ (US)

( * ) Notice: Subject to any disclaimer, the term of this patent is extended or adjusted under 35 U.S.C. 154(b) by 85 days.

(21) Appl. No.: 16/303,930

(22) PCT Filed: May 22, 2017

(86) PCT No.: PCT/US2017/033788

§ 371 (c)(1),
(2) Date: Nov. 21, 2018

(87) PCT Pub. No.: WO2017/205266

PCT Pub. Date: Nov. 30, 2017

(65) Prior Publication Data

US 2020/0315277 A1 Oct. 8, 2020

Related U.S. Application Data

(60) Provisional application No. 62/392,296, filed on May 26, 2016.

(51) Int. Cl.
*A42B 3/04* (2006.01)
*A42B 3/06* (2006.01)
(Continued)

(52) U.S. Cl.
CPC ..... *A42B 3/066* (2013.01); *A42B 3/0486* (2013.01); *A42B 3/122* (2013.01); *A62B 18/04* (2013.01)

(58) Field of Classification Search
CPC ..... A42B 3/066; A42B 3/0486; A42B 3/122; A62B 18/04
See application file for complete search history.

(56) References Cited

U.S. PATENT DOCUMENTS 3,994,020 A * 11/1976 Villari ..... A42B 3/122 2/413
4,287,613 A * 9/1981 Schulz ..... A42B 3/145 2/413
(Continued)

FOREIGN PATENT DOCUMENTS

CN 2476990 Y 2/2002
DE 3537095 A1 7/1986
(Continued)

OTHER PUBLICATIONS

Extended European Search Report in EP17803357.7 (dated Dec. 18, 2019).
(Continued)

*Primary Examiner* — Khaled Annis

(57) ABSTRACT

An air inflatable and thus collapsible when air is removed, safety helmet preferably comprised of multiple inflatable lobes with a head conforming and surrounding inflatable ring and separate or integrated skull cap, for wear by the user, for placement on top of the lobes and/or for location within the chamber(s) formed of the lobes, or worn by the wearer directly upon the head, made of flexible, force absorbing and dissipating material. The lobes and ring are provided with quick release air inflation and deflation valves. The safety helmet can simply alternatively comprise air inflatable lobes with a minimally elastic outer covering to encase and minimize the movement or air within the chambers during a collision.

14 Claims, 10 Drawing Sheets

(51) Int. Cl.
*A42B 3/12* (2006.01)
*A62B 18/04* (2006.01)

(56) References Cited

U.S. PATENT DOCUMENTS 4,566,137 A * 1/1986 Gooding ..... A42B 3/122 2/413
4,853,980 A * 8/1989 Zarotti ..... A42B 3/121 2/413
5,014,365 A * 5/1991 Schulz ..... A42B 3/122 2/412
5,175,889 A * 1/1993 Infusino ..... A42B 3/122 2/413
5,259,070 A * 11/1993 De Roza ..... A42B 3/0486 2/413
5,259,071 A 11/1993 Scott et al.
5,263,203 A * 11/1993 Kraemer ..... A42B 3/122 2/413
5,846,063 A * 12/1998 Lakic ..... A42B 3/122 417/440
5,890,232 A * 4/1999 Park ..... A42B 3/122 2/413
6,073,271 A * 6/2000 Alexander ..... A42B 3/122 2/413
6,178,560 B1 * 1/2001 Halstead ..... A42B 3/122 2/413
6,226,801 B1 * 5/2001 Alexander ..... A42B 3/122 2/413
8,336,122 B1 * 12/2012 Harris ..... B32B 25/04 2/412
9,032,549 B1 * 5/2015 Cameron ..... A42B 3/122 2/68
2002/0166157 A1 * 11/2002 Pope ..... A42B 3/122 2/413
2003/0140401 A1 * 7/2003 Ku ..... A42B 3/122 2/413
2008/0282453 A1 * 11/2008 Alstin ..... A41D 13/0512 2/413
2010/0180363 A1 7/2010 Glogowski et al.
2011/0252544 A1 * 10/2011 Abernethy ..... A42B 3/122 2/413
2011/0271427 A1 * 11/2011 Milsom ..... A42B 3/128 2/413
2013/0014313 A1 * 1/2013 Erb ..... A42B 3/122 2/410
2013/0061375 A1 * 3/2013 Bologna ..... A42B 3/127 2/414
2013/0152287 A1 * 6/2013 Cormier ..... A42B 3/124 2/459
2013/0174331 A1 * 7/2013 Witcher ..... A42B 3/122 2/413
2013/0219594 A1 8/2013 Ferguson
2013/0276213 A1 * 10/2013 Olsson ..... A42B 3/0486 2/413
2014/0020158 A1 * 1/2014 Parsons ..... A42B 3/121 2/413
2015/0257471 A1 * 9/2015 Warmouth ..... A42B 3/122 2/413
2016/0021966 A1 * 1/2016 Warmouth ..... A42B 3/105 2/413
2016/0058094 A1 * 3/2016 Vance ..... A42B 3/122 2/413
2017/0120134 A1 * 5/2017 Warmouth ..... A42B 3/205
2017/0189786 A1 * 7/2017 Riggs ..... A42B 3/122
2018/0049508 A1 * 2/2018 Terry ..... A42B 3/283
2018/0343953 A1 * 12/2018 Erb ..... A42B 3/064
2019/0116910 A1 * 4/2019 Aharouni ..... A42B 3/328

FOREIGN PATENT DOCUMENTS

DE 4240643 A1 1/1994
EP 0394726 A1 10/1990
FR 1071094 A 8/1954
GB 2404328 A 2/2005
KR 100973975 B1 8/2010

OTHER PUBLICATIONS

International Search Report in PCT/US2017/033788 (dated Oct. 2, 2017).
Written Opinion of the International Searching Authority in PCT/US2017/033788 (dated Oct. 2, 2017).

* cited by examiner

INFLATABLE SAFETY HELMET

PRIORITY CLAIM

The present application is a non-provisional utility patent application based upon PCT international application Serial No. PCT/US2017/033788, filed May 22, 2017, which claims priority to U.S. provisional patent application Ser. No. 62/392,296, filed May 26, 2016, by the same inventor and priority thereon is claimed. Furthermore, the entire specification, its teachings, including the written description and the drawings of the PCT application and the provisional application are incorporated herein in their entirety.

BACKGROUND OF THE INVENTION

The present invention relates to an inflatable helmet, primarily intended for use by bicycle riders to protect their heads from injury as a consequence of bicycle accidents. The inflatable helmet will provide a sufficient degree of protection when the head would otherwise come into contact with a hard surface, automobile, telephone pole and/or the ground, etc. such that the helmet will a) pass current safety and impact requirements of the Consumer Product Safety Commissions impact testing of the same and b) the helmet will be lightweight, easy to use, and, significantly importantly, deflatable such that it is collapsible so the same can be easily and compactly/conveniently carried about until needed for use. The deflated condition of the otherwise inflated helmet will occupy a far smaller volume of space than it does when inflated and intended to be worn as a safety helmet.

The present invention, an inflatable and deflatable/collapsible helmet to protect a wearer's head, preferably for wearing use by a bicyclist, primarily comprises an air inflatable chamber or envelope, shaped like a traditional hard composition bicycle helmet, with one or more simple inflow and release air flow valve(s). The helmet is shaped and conformed to the head of a wearer (different sizes for different ages or sizes of bicyclists) and further comprises an impact resistance component, shaped as a skull cap, either housed in the envelope, or to be worn on the head beneath the helmet or even secured or held on the top surface and outside of the top surface of the helmet. The impact resistance compound, preferably a gel, is itself foldable for storage and, yet, when used with the inflated helmet will absorb and distribute the impact of a collision and "sacrifice" the head covering to the advantage of the wearer's head. Stated differently, the impact resistance or impact absorbing compound of the skull cap (whether directly worn on the head, within the envelope or air-holding chamber of the helmet, or on top of the helmet) if subject to force of an impact will absorb and distribute the same such that the full force of the impact is not borne by the wearer's head. This is similar to the manner that a bullet proof vest, with Kevlar® absorbs the impact of a bullet to protect the wearer of the vest. Bicycle accidents can be severe and highly injurious to the head of the cyclist if no helmet is worn. The present invention is intended to protect the wearer and head of the cyclist while, at the same time, being easily and quickly collapsible and transported in a smaller volume or package until ready for use and deployment as a helmet. The present invention is meant as a compactable, effective and safe substitute for the always large, three-dimensional and hard impact resistant helmets now made and sold. By providing a deflatable/collapsible and easy to tote helmet, which is still capable of protecting a wearer's head if subject to impact from a bicycle accident, users will be more prone to carrying and using the smaller helmet than toting a large helmet. Because of the size and inconvenience of the larger, hard helmets, bicyclists often choose not to wear them at all as they are not easily toted, after the bicycle ride is finished.

Thus, the present invention relates to an inflatable and collapsible head-protective helmet with one or more air inflatable chambers, a valve for each chamber to allow for air to enter, under compression, to inflate the helmet, the valve sealing the air inside the chamber(s) and for the contained air to be selectively bled out when the valve is opened, when the helmet is finished for its then intended use, until the next use, and, yet, by use of an impact absorbing gel-like layer, integrated or not within the helmet but, nevertheless, on the head, preferably within the chamber(s) or on top of the head within the helmet, will protect the bicyclist's head, in the event of an unintended collision or accident where the wearer's head would otherwise directly contact a surface and cause possibly severe injury.

Three embodiments are currently contemplated by the present inventor, namely, a first embodiment wherein the air inflatable lobes forming a helmet-like shape with a cavity for the head is made of an elastomer material that will hold air. That helmet will be desirably encased in a fabric that has minimal elastic properties, like a nylon, polyester, Cardura, or any other fabric that limits or tends to limit the expansion of the elastomeric, inflatable lobes. This first embodiment is preferably provided with a skull cap, intended to be secured to the inside of the lobes forming the cavity and that skull cap and helmet is worn by the cyclist.

In the preferred embodiment of the invention, the skull cap is impact absorbing and dissipating of the contact forces of an accident. In an alternate embodiment, the interior skull cap can be of a cotton netting materials with an elastic ring, for example, to snuggly hold and fit the same to the head. Alternatively, the inside skull cap can be foam to aid the absorption of the impact to the wearer in the event of a fall or accident, or it could be formed of an elastomer or any other suitable variety of material.

In an alternate embodiment of the present invention, the skull cap made of an impact absorbing and dissipating material, preferably a flexible gel, a semi liquid, a liquid or combinations thereof. And, in alternate versions of this embodiment, the impact absorbing and dissipating material, i.e., the skull-shaped cap can be inside the cavity of the helmet and directly worn on the head, on the top or outside of the helmet, and/or actually housed within the inflatable envelopes forming the air-inflatable cavity in the shape of the lobes.

When one falls from a bicycle, the head encounter's much, much more than one g of force. This is a consequence of the speed and acceleration of the fall towards the hard object. According to the Consumer Product Safety Commission's drop test, a helmet needs to be able to sustain a 14 miles per hour crash as that is about how "hard" one hits when a fall form two meters is sustained with no forward speed. Forward speed adds some additional force, of course, One reason for a helmet to be rounded is to minimize snagging of the helmet with the ground as the more snagging; the more forces of impact between ground and the helmet. The roundness and smoothness of a well-designed helmet is meant to allow the helmet to skid, not snag, and that helps minimize injury. Without any helmet, the head can transmit a thousand or more g's to the brain/head in about two thousandths of a second, as the individual comes to a violent, very sudden stop on the hard, relatively unyielding pavement. With a helmet between the rider and the pavement, the stopping time can be stretched out to about seven or eight thousandths of a second by the crushing of the helmet material. That little bit of delay and stretching out of the energy pulse can make the difference between life and death and/or brain injury.

The US Consumer Products Safety Commission provides a standard test for bicycle helmets. The steps of the test are set forth at www.helmets.org/testing. The impact component of the testing process is a drop test. The helmet is strapped onto a headform, held upside down on a test rig that guides the fall onto a stationary anvil. This rig in the COSC lab is a monoral and the drop of the helmet is guided by a single rail. Other similar testing rigs use two parallel yet thin wires. Then, the lab technician raises the helmet (strapped to the headform) until the top of the helmet is a specified distance from the anvil below. A trigger lets the helmet drop in free fall until the helmet hits the anvil. The velocity of the drop is checked just before the impact to ensure that the speed was correct. An accelerometer is used to measure the g's in the center of the headform. If the helmet works "well" the g's are low, probably below 200, and in the better helmets, the g's are reduced to about 150. If the g force exceeds 300, the helmet "fails" the test. Three anvils of different shapes are used. A flat anvil is used with a 2 meter drop. There the helmet and headform are traveling at about 11 mph at impact. A 1.2 meter drop is used with a hemispherical shaped anvil. There the helmet and headform are travelling at about 11 mph at impact. The hazard or curbstone anvil is rounded like the edge of a roadside curb and there the top is about 1.2 meters, too, representing about 11 mph at impact. A helmet that passes all test is certified to be consistent with the "standard." If it fails, it is not certified. And, there are no qualification for passing, it either passes or doesn't.

DESCRIPTION OF THE PRIOR ART

Today, there is a large and increasing market for items which provide safety to one's body parts while active individuals are exercising. More specifically, bicycle riding is a very popular activity, enjoyed by children, young adults and adults. The bicycles (even tricycles) are used on a variety of road surfaces, including driveways (asphalt, dirt, brick, etc.), roads, paths, even on the sides of mountains. All are available and used by millions of riders for exercise, excitement and fun. However, this form of exercise has an element of risk as one can lose their balance or hit something in the road (or something can hit the cyclist) all resulting in a fall and, with a fall, a possible head contact and injury. Head injuries can be quite serious and even result in death. Thus, it is highly recommended and ever law in some States of the US for cyclists on public roads to wear head covering and protecting helmets. And, in some instances those helmets much "pass" safety tests such that they can withstand certain minimum forces which might impact on the head of a cyclist in an accident. Bicycle helmets are thus mandatory in many states of the United States and highly recommended, in any event, even if the cyclist is riding in a state where the helmet is non-mandatory or off road. Prevention of a bruising or crushing head injury is highly important to the long term health of the cyclist.

Towards that end, helmets have been designed to fit on and be held to the head to provide protection. Those helmets have been made of strong materials and composites, similar to that worn by football players. They are meant to allow for the wearer to clearly see the path of travel, be lightweight as the same is supported by the neck, be aerodynamic so as not to too negatively impact on the performance of the cyclist, and preferably light weight for carrying when the user is not upon the bicycle. A critical and thus quite important characteristic of these helmets is the ability to protect the head in the accidental event of a head crash and to minimize injury and damage to the head. Towards that goal, there is an inherent conflict of providing a light weight helmet and a head-injury protective helmet. However, the plastic-based and other composite helmets balance the trade off and provide helmets which are relatively strong in impact resistance and, while relatively light weight to be easily borne by the neck and head, they are bulky to carry when not worn as a helmet. The strength and rigidity of material thought needed to protect the head is also counter or in conflict with the desire of many cyclists to be able to tote the same in a small package. That inherent conflict between required strength to withstand impact to protect a head and smallness or compactness of volume when not needed as a helmet, i.e., when not worn, for ease of portability until needed again for use, is the solution sought and achieved by the present invention.

There have been inflatable items, of course, for protecting body parts, e.g., air inflated slings for arms and legs. These were never thought of, to this inventor's knowledge, to be able to be used as a head protective helmet as the same would not pass the Consumer Products Safety Commission's test of bicycle helmets nor able to withstand the potential forces of a cycling accident. And, there have been, of course, head protective helmets of the hard plastic type for use by football players, cyclists, and other game players (hockey, lacrosse, bobsledding, etc.). But they are always large and bulky, even when not in use. The present invention is an air inflatable helmet comprising basically two layers of thin plastic material seamed at edges and thus defining between the layers an air holding chamber(s). The chamber is inflated with air from the lungs of a user or, far more preferably, from a source of compressed air so that the pressure of the air within the chamber is higher, for making the chamber(s) more resistant to the forces of an accident. However, providing a mere air-inflatable helmet by itself, it has been determined, will not adequately withstand the rigors and impact required for a head-protecting helmet, at least not according to the testing done on the hard helmets. This is especially so in connection with manufacturing a helmet which is intended to be able to be repeatedly inflated and then deflated for folding into a smaller volume for ease of handling and transporting between uses, especially one still light weight enough to be easily and conveniently toted.

Toward the desired goal of providing a helmet which is simultaneously able to be folded into a smaller than its size at the time of use as a head protecting helmet and a helmet which adequately protects the head in the event of a crash, the present invention is provided. It is an air-inflatable envelope or set of one or more connected air-holding chambers which conform generally to fit on the head just like the hard composite helmets, is provided with one or more air cooling vents for comfort, a set of thin, preferably plastic connecting straps and latch mechanism for holding the same over the ears and under the chin of a wearer, like a conventional helmet, but with an integrated or separate skull cap, internal cap, or over the top of the helmet, cap, which is made of preferably foldable, gel-like material which significantly absorbs the forces of a bicycle impact and head contact with a hard surface and spreads the same over the impact absorbing material so that the head of the cyclist, located beneath the gel cap and the helmet is protected from direct and serious injury. Of course the air inflated envelope or chamber absorbs, too, some of the forces of the impact but the bulk of the forces are meant to be absorbed and dissipated by the gel-material in the form of a skull cap, made of the highly absorbing material.

The prior art, as mentioned, teaches strong, hard plastic and other stiff material-based head-protecting helmets. However, these are not collapsible into a volume less than the helmet when in its ready-to-use condition. The present invention is both convenient to carry when not used as a helmet and, yet, will protect the head from serious injury when inflated with air, as a consequence of the synergistic effect of the gel-like skull cap and the air inflated helmet, the holder for the skull cap.

The prior art teaches, too, materials, like Kevlar® material which protects body parts from bullets, when integrated into body-protective armor. However, that material, is stiff and has not, to the inventor's knowledge been considered for and integrated with an air-inflatable and head conforming, inflatable and deflatable helmet. Impact Gel has been used for manufacturing cases for smart phones, for bicycle seats and motorcycle seats and for foot insoles. To applicant's knowledge there has not been a suggestion, before the present invention, to use the same as a component for use with an inflatable helmet to protect the head.

The prior art also teaches the use of air inflatable small chambers or envelopes within hard-hat like helmets to conform and hold the helmet more securely and comfortably to the head of the wearer and to provide some measure of head protection in the event of an impact. However, to the inventor's knowledge, no one has provided a collapsible helmet, one that can be folded or compacted into a small volume when not used as a helmet along with a foldable, impact absorbing material as a skull cap.

SUMMARY OF THE INVENTION

The present invention basically comprises one or more air inflatable chambers or a sealed air holding envelope, generally shaped like the hard/composite bicycle helmets now available for the heads of bike riders. Preferably, the present invention uses urethane or a similar material for the layers forming the inflatable envelopes for the helmet. Urethane is durable, does not easily burst, will tend to hold the air within the formed chambers, and seems superior in preventing air leakage out through the layers. The envelope is provided with one or two (or more) air inflatable valves (one for each sealed chamber) which allow for the selective introduction into the envelope or chamber of a quantity of air, whether from blowing in by a user's lungs or, preferably because of the higher psi capable of being introduced into the chamber, via a source of compressed air. The valve(s) when opened allow for the air to be introduced into the chamber(s) and, then, when the envelope is fully inflated, the valves are closed, to contain and maintain the helmet in its inflated condition. When it is desired to deflate and fold and package the helmet in a purse, briefcase, small box or pocket, for example, the valve(s) are re-opened and the air contained therein is able to be pressed out and pass through the valve(s) and into ambient air. Then, the thin, flexible, plastic walls of the envelope can be crushed or folded so that the helmet assumes a condition, volume and shape far smaller than the inflated helmet.

The inflated helmet is in a general helmet shape (concave towards the head of the wearer to accept a head within and, like a conventional helmet, convex when viewed from the top) all meant to generally conform to the wearer's size and shape of head, like traditional bicycle helmets. While the helmet, when deflated and folded, is intended to be of far smaller volume, to allow the same to be easily carried from use location to next use location (where it will need to be re-inflated), the helmet disclosed herein is intended to protect the wearer in the event of an accident, where the head of the wearer may otherwise come into direct contact with a hard surface.

In one embodiment of the air inflatable safety helmet, the exterior or concave outer surface is encased in a fabric or fabric-like material with minimal elastic properties—like nylon, polyester, Cardura or any other fabric material which will limit the expansion of the elastomeric inflatable lobes.

In this embodiment, the interior cavity an be lined with a skull cap, preferably of a cotton netting and/or with an elastic ring to conform and hold the same to the wearer's head. A foam can be used with the netting to minimize the impact of a fall, or another elastomer or any suitable force absorbing material.

In another embodiment, the present invention provides a skull cap of a material which absorbs and dissipates the force of that accidental impact so that the head of the wearer is not severely damaged. That skull cap can be formed of a gel substance of high impact absorbing and dissipating material and can be located separately or integrated beneath the inflatable helmet, can be integrated into and within the inside of the air chamber(s), and/or can be secured to the outside, top of the helmet. The preferred materials is a flexible gel but other materials can be substituted or combined, e.g., foam covered gel, semi-liquids, or merely a liquid within a scull cap envelope or within the chambers of the helmet which are air inflatable. In any location, the impact absorbing material is a component for the air inflatable helmet. The air inflatable helmet conforms to the shape and size of the wearer's head and the air cushion between the layers (i.e. the air chamber(s)) also serve to dissipate and protect the head from severe damage in the event of a bicycle fall, spill, accident, etc. But, the bulk of the accidental forces of head impact are desirably absorbed by the skull cap of force absorbing, preferably gel-like material. Thus, the air inflatable helmet is a safety device for use in connection with activities where protection of the head is desired and this helmet is capable of being compacted, when not needed as a helmet, into a volume smaller than that of the helmet when used for cycling.

The helmet in its preferred form is air inflatable thin layers of urethane but this can be supplemented with a minimally-elastic encasing fabric and then supplied with a interior cap of netting or a skull cap of an absorbing and dissipating material, within the interior of the cavity (sitting directly on the head), within the envelope of the inflatable lobes, or even on the top or exterior of the helmet. The embodiment wherein no such absorbing and dissipating material is use, can be a simple cotton netting with an elastic ring to conform the same to the head and be provided with a minimally elastic foam or sponge like substance within the cavity, or even inside the inflatable chambers.

In addition, the inflatable and lightweight, soft and collapsible helmet can be augmented with hard materials, like a plastic ABS, PVC, Nylon or similar materials, wood, metal or another durable material so that in the event of an impact, the hard material(s) will tend to absorb some if not most of the forces of impact, in addition to the inflatable components of the helmet and the flexible gel.

In one of the preferred embodiments, the air inflatable helmet is provided with several air inflatable lobes forming a head-holding cavity for a rider/cyclist and an inflatable circumferential ring which holds the helmet about the wearer's head. This embodiment is provided with the skull cap of the absorbing and force dissipating material, preferably an impact gel-like substance between the two layers of the air inflatable chambers forming the lobes.

DETAILED DESCRIPTION OF THE DRAWINGS AND THE PREFERRED EMBODIMENT(S)

Figure 1:
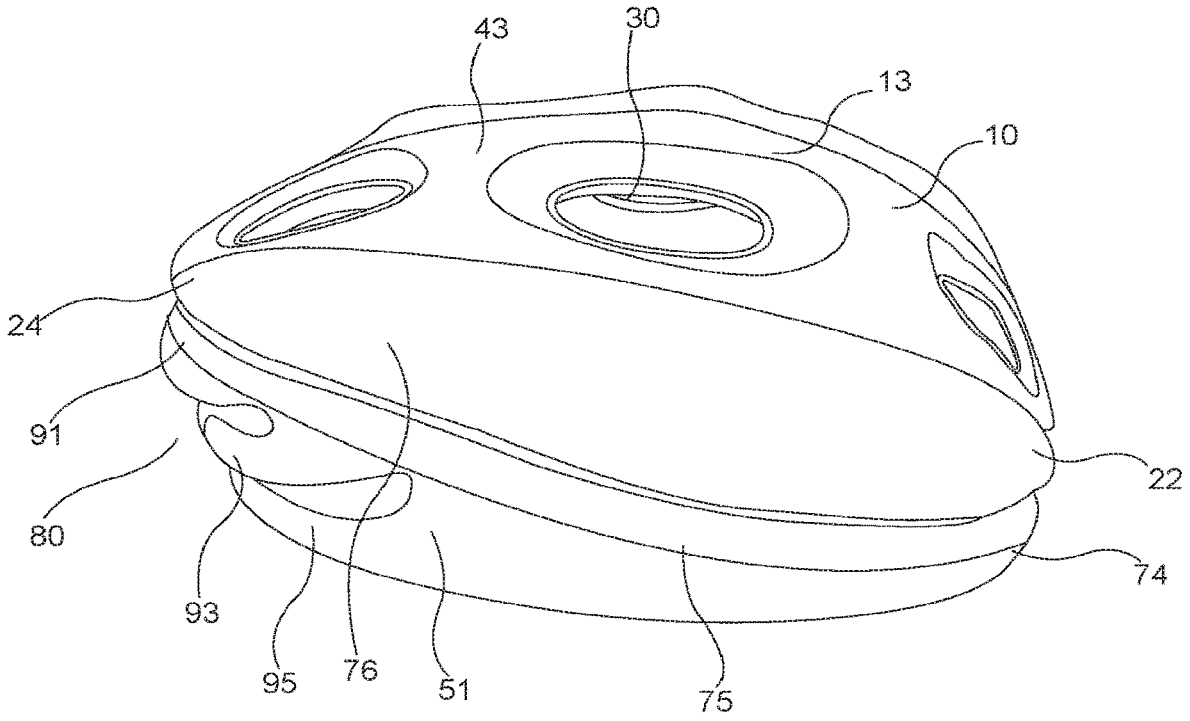
FIG. 1 is a top and side perspective view of the inflatable helmet, full inflated, with the head-holding straps not being shown (tucked under the helmet) for ease of illustration.
Figure 2:
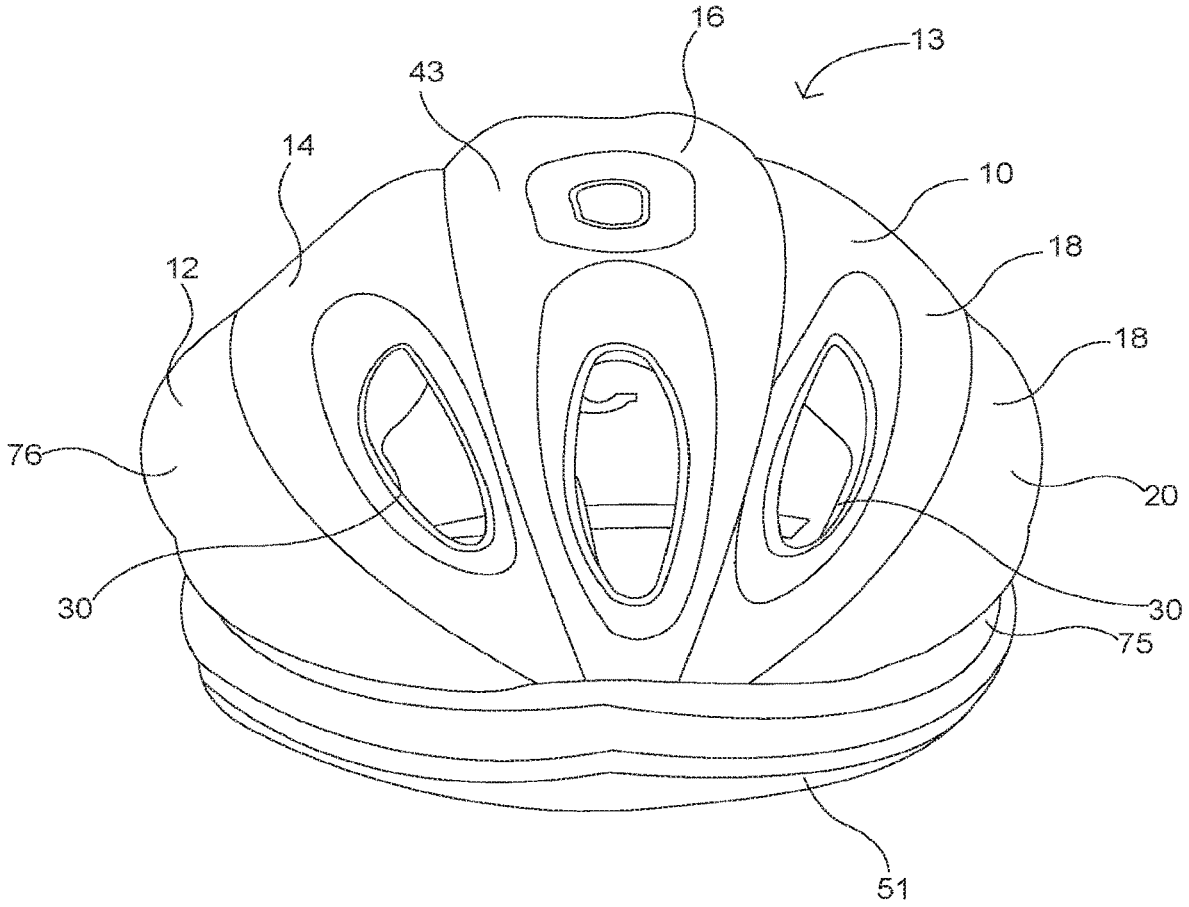
FIG. 2 is a front and top perspective view of the inflated helmet shown in FIG. 1.

As best seen in the Figures and understood by one of ordinary skill in the art, the present invention is an air-inflatable head helmet 10, intended for protective wear during physical activities. The invention has been described with respect to the use of the same by bicycle riders but it should be easily appreciated that the device can be used by wearers in a wide range of activities. As mentioned, today, there is a continuous growing market for supplying devices, especially protective and safety devices, for those interested in health, activity and fitness. And, today, many are actively involved in physical, mobile activities, including high speed or off-road bicycling where accidents and falls/spills may occur. So the present invention can relate to a head protective helmet for a bicyclist, for a motorcyclist, for a rock climber, for a lacrosse player, for a river rafting canoeist, etc. The range of activities where a head protective helmet would be desirable is huge and, yet, many of these activity participants find it undesirable to tote around a large, bulky and weighty helmet. Thus, producing a light weight, compactable yet fully protective helmet is obviously highly desirable. And, doing so at a reasonable price with available materials is also highly desirable. And, of course, having the head protective helmet meet or exceed the standards established by various governmental entities, e.g., Consumer Product Safety Commission, is not only desirable but often critical for marketing and sales. And, doing so in a manner that allows easy and small volume toting can be seen to be highly advantageous to a manufacturer (terrific sales point) and to a consumer.

Nevertheless, while consumers want convenience and safety, they often are placed into situations where they make hurried decisions weighing cost and size and putting little real thought into safety. And, of course, the helmet buying decisions are often made with different considerations in mind and for different activities.

Bicycle riding is becoming very common today. Many daily commuters, even those in cities, are using bicycles for transportation and for exercise. As this ease of mobility increases there is an ever-increasing need for those to be equipped with protective head gear and to have the head gear readily available and not overly heavy nor bulky. The present invention, the inflatable bicycle helmet preferably but not necessarily accompanied with a protective skull cap of impact absorptive material, is a safe, convenient, compact, lightweight and relatively inexpensive solution to the needs of the activist.

Traditional bicycle helmets have a hard shell and are cumbersome. When not in use as a safety helmet during bicycle riding, they are not convenient to carry. A bicyclist, for example, may park his/her bicycle nearby to his office or home and thus available for use when needed, but the helmet is not left with the bicycle because of fear of the same being stolen or lost. Thus, the cyclist will carry the bulky and heavy hard shell of a helmet from the bicycle to wherever he travels, until he needs the bicycle again and thus the helmet again. Carrying the helmet from location to location can be cumbersome and awkward, especially if the cyclist is going to a formal place of business.

Today, too, there are bicycle rental centers located on roads and streets and across urban areas, with numbers of bicycles awaiting rental for use on the city streets. However, a cyclist needs a helmet for protection and unless he or she is already carrying a helmet, it is unlikely he or she will rent the bicycle. However, those with their own bicycles already carry helmets so, the point here is that many individuals who otherwise might rent a bicycle on a whim or for a short need, will not do so, as they don't have an available helmet. And the rental stations don't offer them, generally, for fear of risk of theft of the same. Thus, the present invention, a collapsible yet inflatable safety helmet is clearly highly desirable. A potential cyclist carrying the present invention in his/her pocket or purse or briefcase can easily unfold and inflate the same (whether by one's own air, a small portable cartridge of compressed air or the bicycle rental facility can be equipped with compressed air supply). This provides a safety, head protective helmet and more potential customers for the rental entity and safer bicyclists wearing helmets. More consumers will rent bicycles if they can purchase an air inflatable helmet (which they already are carrying or if the rental facility has a vending machine of boxes of the packaged and deflated helmets disclosed herein with a source of compressed air).

According to the invention, there are three basic versions or embodiments of the air inflatable safety helmet. In the first embodiment, two thin layers of elastomeric material are provided and shaped to form, when inflated, a safety helmet for the head. Preferably, the safety helmet will visually resemble, when inflated with air, the current hard and non-compressible safety helmets for bicycle riders. In the inventive embodiment, however, the helmet is formed from the elastomeric materials, preferably two overlapping layers, sealed and seamed at the edges and to form the shape of a basic helmet and provided with air valve(s) for selective inflation and deflation.

In one of the preferred embodiments of the present invention, the air inflatable safety helmet is encased within a fabric or fabric-like material which is minimally elastic, to hold the deformation to a minimum if the air inflatable lobes come in contact with another material, e.g., a wall, ground, tree, etc., i.e., in a hard contract situation for the head (crash, fall, accident, etc. by the wearer). The encasing fabric will thus limit the expansion of the elastomeric interior (the air inflated lobes). This embodiment can also be provided with a skull cap attached to the interior chamber formed by the air inflatable lobes or integrated to and within the cavity of the helmet or the skull cap can be a separate component worn by the wearer. The material of that skull cap, in this embodiment, can be a foam or another elastomer material or selected from materials which provide some measure of comfort, wearability, force absorbing, etc.

In a preferred alternate embodiment of the invention, the skull cap is formed of an impact absorbing and dissipating materials, preferably a gel, liquid, or similar material which is secured within the interior of the cavity of the helmet, held within the interior chambers of the lobes of the air inflatable helmet and/or secured and integrated into the top surface of the helmet.

Figure 6:
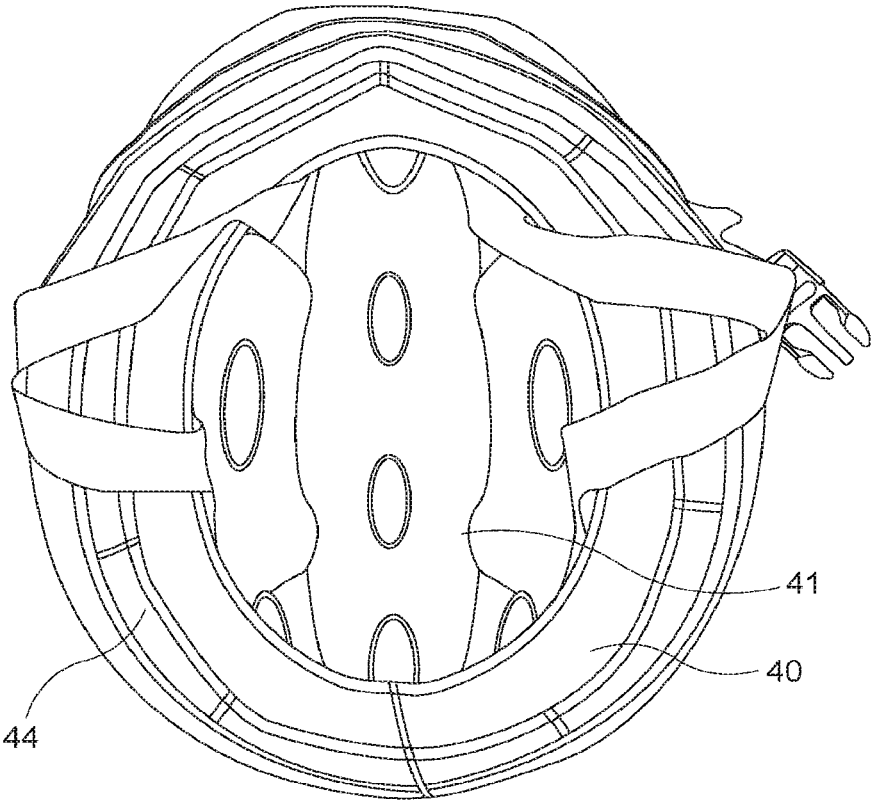
FIG. 6 is a bottom plan view of the inflated helmet shown in FIGS. 1-5 and shows the head-holding straps pulled outwardly with the clasping halves of a buckle mechanism for the straps, unconnected.

According to the present preferred embodiment of the invention, the helmet 10 is shaped, when inflated, like a conventional helmet with a concave interior 11 (see FIG. 6) for providing a cavity to conform to the shape and size of the head of the cyclist and a convex exterior or top surface 13, just like conventional helmets. The top is preferably formed into several envelopes or lobes, like today's conventional hard helmets for streamlining the same as bicyclists want to reduce drag while cycling. In the embodiment shown in the Figures, there are preferably 5 top lobes, 12, 14, 16, 18 and 20, extending from side of the head to opposite side of the head, with lobe 16 being the top, center of the helmet 10. The lobes extend, from side of helmet to the other side of the helmet, from front 22 to rear 24 of the helmet 10. As seen in the Figures, one or more oval-shaped openings or air holes 30 are provided for allowing air to circulate through the helmet, for the comfort and cooling of the user. Preferably, the openings or air holes 30 are through lobes 14, 16 and 18 and not through outside lobes 12 and 20.

The helmet 10 is made from thin layers of plastic or elastomeric material preferably the type of material used in inflatable toys, swimming pool rafts, punching bags for children, beach balls, floating animal-shaped toys for backyard pools, etc. The helmet, like a pool raft, is formed from two layers of the plastic, seamed together at least at the outside edges to form air holding chambers and, in the case of the bicycle helmet shown and intended to simulate a conventional helmet, having multiple lobes. Like a pool raft, the entirety of the same can be a single chamber of sub-chambers in fluid (air) communication with one another but with interior side walls for providing shape and rigidity or the device can be formed of two or more separate chambers. In the preferred embodiment of the present invention, the top of the helmet 10, comprised of the lobes, is a single chamber with 5 sub-compartments and there are interior walls between the lobes to define them. Forming of the separate lobes is either done with interior walls connecting the top to the bottom layers of plastic on the inside of the lobes or the top and bottom layers of plastic are seamed (by heat sealing, adhesive or other means) together to form and shape the top of the helmet.

Figure 9:
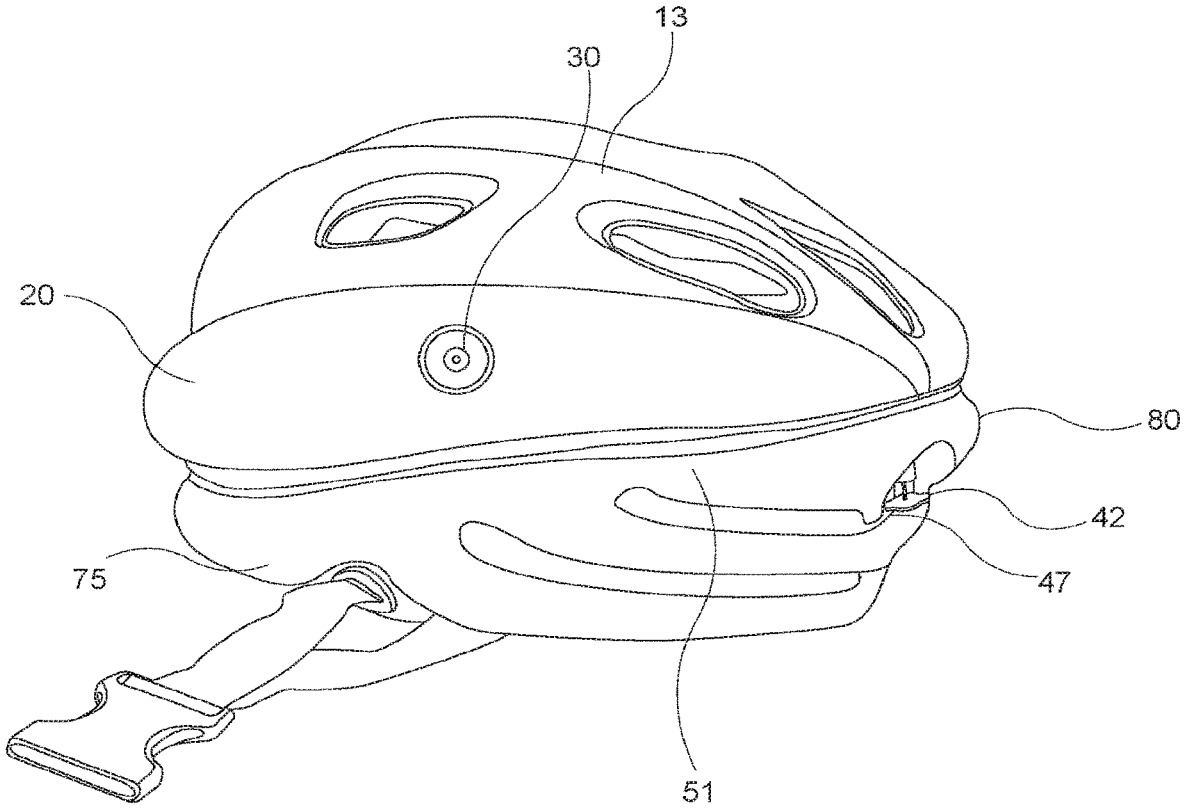
FIG. 9 is a front, top and other side perspective view of the helmet of the other Figures, inflated, and shows the other head holding strap shown in FIG. 8 which surrounds the other ear of the wearer and is provided with the other half of the buckle mechanism for holding the helmet to the head of a wearer.

The lobes can be provided with one or more air inflation valves, just like those used in pool toys for allowing, when in the open position, air blown or forced into the chamber or lobe to inflate the same, and a round plug or closure for maintaining the air within the chamber or lobe after inflation and during use of the device as a helmet. The valves are closures which can be selectively opened for allowing air to inflate the lobes but can also be opened to allow for selective deflation. The lobes can be individual front to back envelopes with individual valves or one or more of the lobes can be in fluid (air) communication with the other lobe(s) with one or more valves. This, again, is quite similar to manner of constructing pool rafts and other backyard water and inflatable toys and devices. In the preferred embodiment of the present invention, there are five distinct lobes which are connected together and inflatable through a single air inflation-deflation valve 30 (see FIG. 9). That valve is on one side of the helmet 10, in the embodiment shown, with the valve directly located within lobe 12. The valve 30, like the other valves to be described in connection with the present invention, is substantially the same type of valve used on many blow up or inflatable pool toys and items. The valve 30 in the preferred embodiment is located at the side of the helmet. It is provided with a pull tab and plug cap (as is conventional) to facilitate pushing the plug of the valve into the air tube extending into the chamber and thus to close off the air passageway and to be pulled away from the surface of the helmet, to remove the plug from the air passageway, to allow air to easily flow out of the lobe(s). In the preferred embodiment the valve is of the type provided with an interior flap which allows air to easily flow into the lobe(s) when a source of lung-blown air or preferably compressed air is forced into the air passageway and, yet, the interior flap (well known and conventional with water toys and other inflatable items) will tend to block air outflow unless the valve and its air passageway are pinched together.

The lobes of the inflatable helmet are preferably formed with a set of interior walls, extending from the top layer of the helmet towards the interior bottom layer and, yet, the interior walls do not fully extend from front to back of the helmet as the lobes, as mentioned, are in fluid communication with one another so that compressed air flowing through valve 30 will fill not only the lobe to which it is attached (20) but also flow to and fill the other lobes 12, 14, 16 and 18 and, yet, the interior side walls will maintain the shape of the lobes, corresponding visually quite closely to that of conventional hard helmets for bike enthusiasts, as they currently are marketed and sold. Or, the top layer of plastic can be simply sealed to the bottom layer of plastic to form the multiple lobes.

For purposes of providing some measure of safety to the head, the air flowing into and held within the lobes must provide no less than about 10 psi. This is generally not available by using lung power alone and, so, inflation of the present helmet may need to be done by a source of compressed air, available in the future, possibly, at bicycle racks in urban areas, gas stations, a hand pump or another personal device, possible equipped with an air-holding cartridge.

Figure 7:
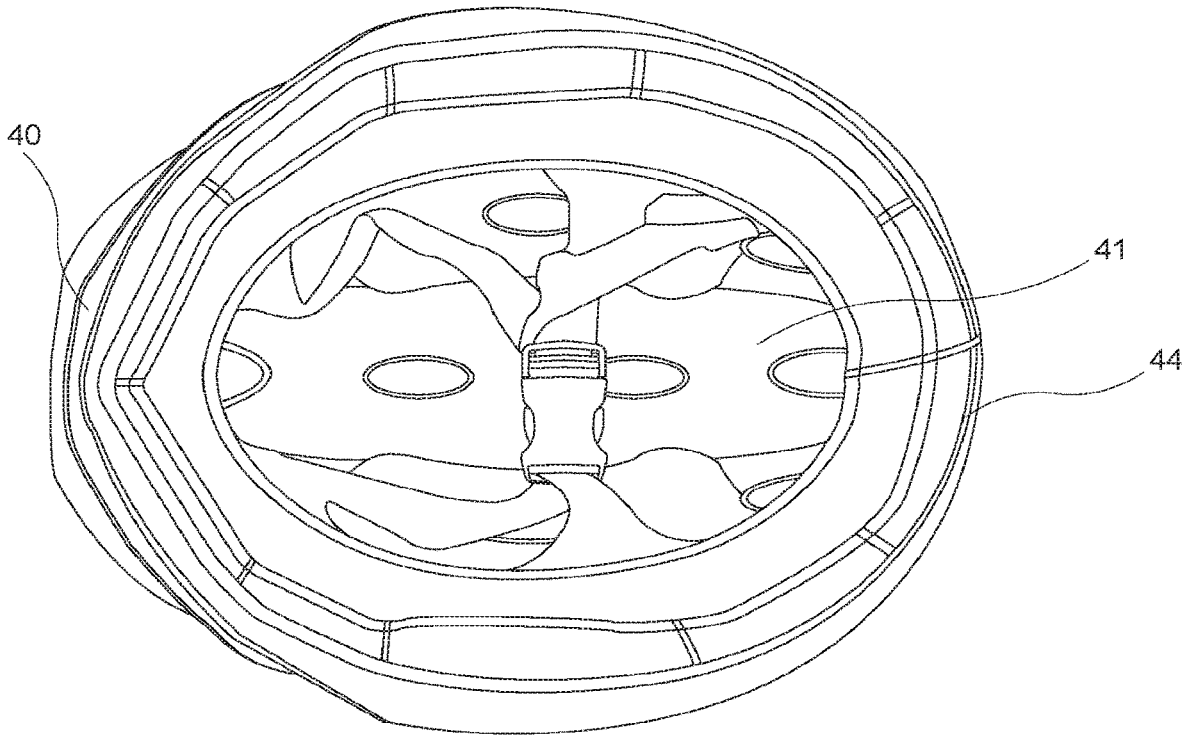
FIG. 7 is a bottom plan view of the helmet, similar to that of FIG. 6 and showing the head-holding straps and now showing the clasping halves of the buckle mechanism clasped together as would be done to hold the helmet onto the head of the wearer, with the straps extending around the ears of the wearer and the buckle beneath but behind the chin of the wearer, i.e., at the top of the front of the neck.
Figure 8:
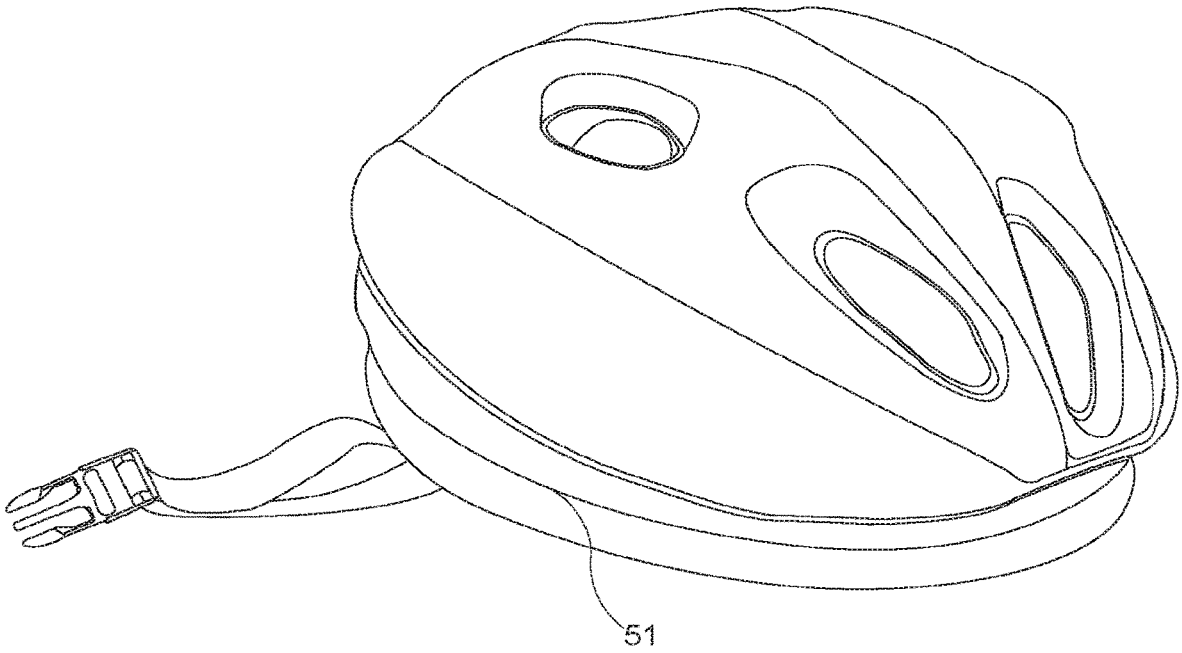
FIG. 8 is a front, top and side perspective view of the helmet of the other Figures, inflated, and shows one head holding strap which surrounds the ear and is provided with one half of the buckle mechanism.

The lobes of the helmet, as mentioned, extend from front of the helmet to back and side to side. The lobes are formed into a head holding interior cavity 41 (see FIGS. 6 and 7). The outside of the helmet 43 is streamlined for aerodynamics. And, as mentioned, a set of air holes 30 are formed in and completely through the lobes, as shown, to allow for cooling of the wearer's head and to allow heat generated by the cyclist's head to flow out (much like conventional helmets). The air holes are formed in and through the lobes by die or otherwise cutting material from the lobes and then heat sealing or otherwise securing the edges of the layers about the air holes. Preferably and as shown, the air holes 30 are created through central lobes 14, 16 and 18 and not through lobes 12 nor 20. Preferably, the lobes 12, 144, 16 and 16 extend downwardly from the top of the helmet to a sufficient degree such that the bottom edge of the helmet extends to at least above the top of the ears, if not fully covering most of the ears and the forehead.

In one embodiment of the present invention, the top of the surface of the layer forming the lobes is provided with a minimally elastic material like nylon, polyester, Cardura or any other fabric or fabric like material that will limit to some degree the expansion, due to contact with a hard surface as during a collision, of the lobes and tend to maintain the shape of the same to provide maximum air between the external point of contact on the outside layer of the lobe and the inside layer, adjacent the wearer's head. Maintaining the shape of the otherwise easily deformable lobes will tend to maintain an air cushion and will tend to minimize the damage to the head in the event of a crash or accident.

In this embodiment, it is preferred, but not essential, that a skull cap be provided which is either integrated into the air chamber, secured to the inside of the cavity of the helmet or merely a separate component worn by the helmet wearer. According to this embodiment, the skull cap is alternatively formed of a cotton netting, set of inflatable lining chambers, an elastic ring to have the helmet conform to the shape and size of the head, a foam, etc. all to aid minimizing the impact to the wearer in the event of an accident or fall.

In an alternate embodiment, the outside of the air inflatable lobes are "naked" i.e., not provided with the minimally elastic fabric for holding the shape of the helmet in a crash or fall, but, rather, the skull cap is made of an impact absorbing and dissipating material, see below, which is integrated either to the top of the helmet, within the cavity of the helmet, within the chamber(s) of the lobes of the air-inflatable helmet and/or by a separate component, not integrated but to be worn by the wearer atop his/her head.

Finally, the third and currently preferred embodiment of the present air-inflatable safety helmet contemplates that the skull cap, formed of a gel-like substance which is force absorbing and dissipating, is contained within the air chambers, i.e., within the lobes so the same is not visually perceptible to another. This ensures that the skull cap is in place, where it should be, to protect the wearer in the event of a crash or accident.

In the preferred embodiment, the helmet 10 is also provided with an air inflatable ring 40 which encircles the helmet 10. The ring 40 is comprised of a circular air tube 44 for surrounding the head of the wearer. The ring 40 or air tube 44 is meant to be secured beneath the outer lobes 12 and 20. The circular air tube 44 is itself inflatable and extends around the wearer's head, from forehead, to the temples and to the rear of the head of the wearer. As a consequence of it being air inflatable, too, it will easily conform to the shape and size of the head and gently but securely hold the helmet to the head. The inside diameter of the air tube is meant to correspond to the outside diameter of the wearer's head while the outside diameter of the air tube 44 is about the same as and seamed to the bottom of the two outermost lobes 12 and 20 of the helmet 10.

The circular air tube 44 is provided with its own air valve 42 (see FIG. 9) which allows the circular air tube 44 to be inflated, sealed (to prevent premature deflation) and then opened to effect intended deflation. The circular air ring encircles the head and preferably passes near the top of or over the middle of the wearer's ears, across the forehead and at least partially covers the rear of the wearer's neck. It is intended to be a head-protective helmet. Preferably, the valve 42 is located at the rear of the helmet. More preferably, the valve 42 projects rearwardly and through an opening 47 in the base 51 of the helmet 10.

The bottom edge of the two outermost lobes 12 and 20 and the small sections of the interior lobes 14, 16, and 18 which extend to the front and back of the helmet is the point of connection or seaming/sealing with the inside edge of the air inflatable ring 40.

The base 51 is connected to the bottom of air tube or inflatable ring 40. The base 51 comprises a forward or leading small diameter tubular section 74, a rearwardly extending set of arms 75 wrapping around the outside lobes 12 and 20 and increasing in diameter as they wrap towards the rear 24 and a rear helmet section 80.

The circular air ring 40 provides the primary mechanism for securing the helmet around the wearer's head. The circular, air inflatable tube or chamber 40 is provided which extends inwardly around the wearer's head. This tube is meant to wrap around the wearer's head and is held and conforms to the wearer's head size, extending across the forehead, just above or across the wearer's ears to across the back of the neck.

Figure 3:
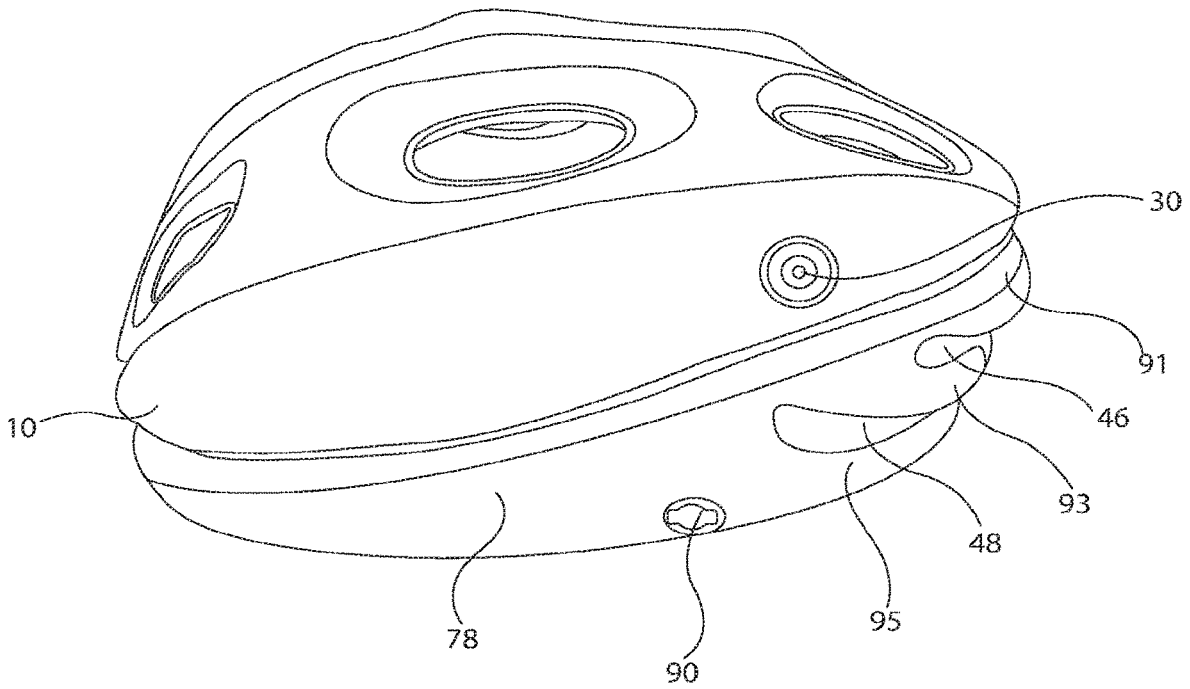
FIG. 3 is the top and other side perspective view of the inflated helmet of FIGS. 1 and 2 with the head-holding straps being tucked under the cavity of the helmet, for ease of illustration and viewing.
Figure 4:
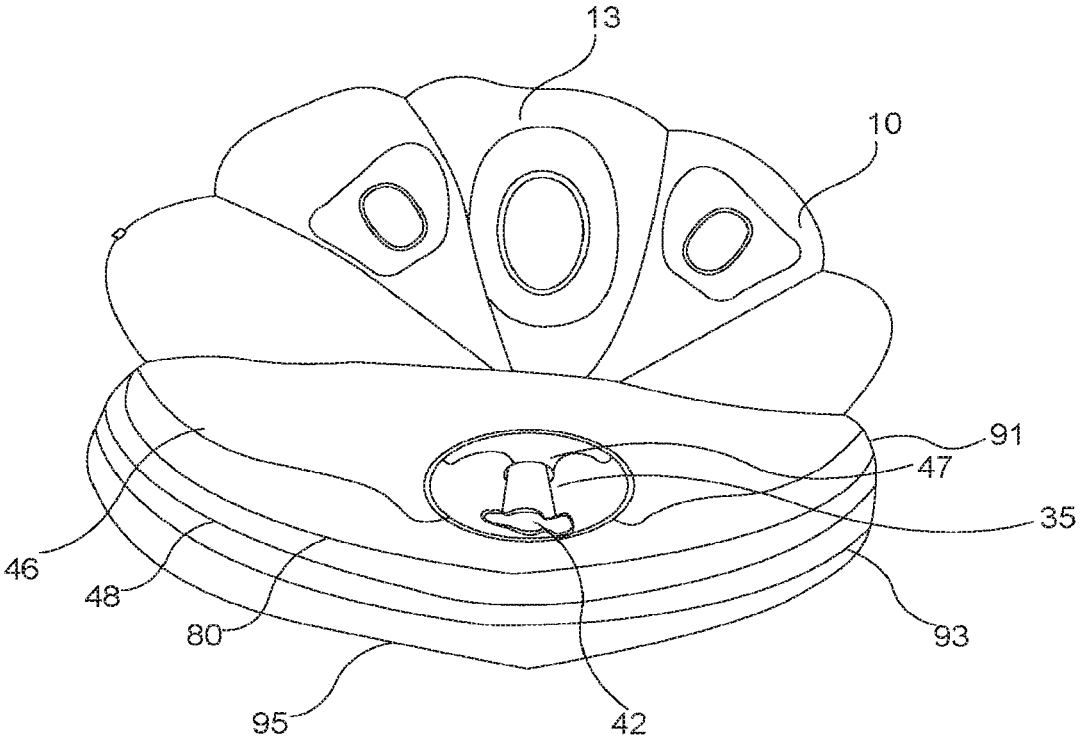
FIG. 4 is a top and rear perspective view of the inflatable and inflated helmet shown in FIGS. 1-3.
Figure 5:
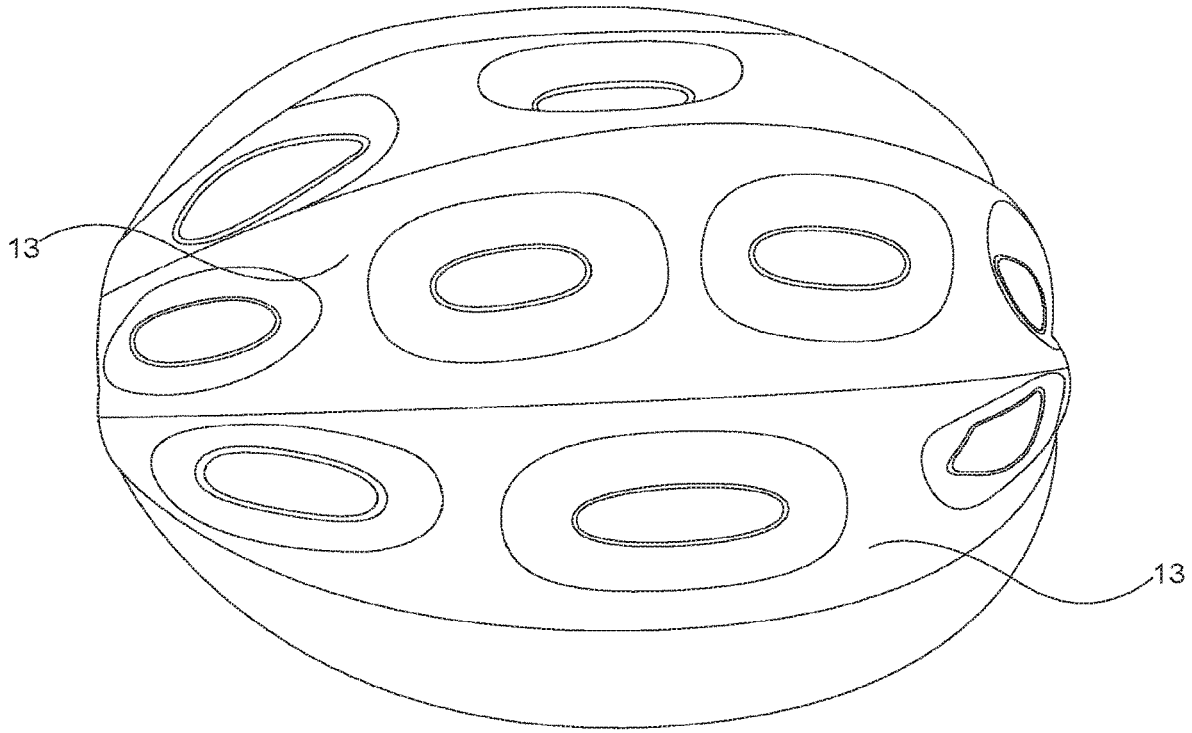
FIG. 5 is a top plan view of the inflated helmet of FIGS. 1-4.

The base 51 and the circular air ring 40 are comprised of air inflatable envelopes, formed from two layers of sealed together or adhered plastic to form air-inflatable chambers and each provided with an air valve for filling, holding and releasing air, as desired. In the preferred embodiment, a conventional air valve 42, is provided for the air ring 40 which extends through and is accessed via an aperture 47 of the rear helmet section 80 of base 51. In the preferred embodiment, the valve 90 for the base 51 is on the side of either the left or the right side sections 76 or 78; in the drawings the valve 90 is shown passing into the base 51 through the left side of the base, as seen in FIG. 3. The rear helmet section 80 is provided, by heat sealing (or otherwise adhering) sections of plastic layers together, with a set of rearwardly extending contour lines 46 and 48. These are meant to provide a measure of aerodynamics to the helmet as wind will be swept off the sides of the helmet and rearwardly and off of the rear of the helmet.

It will be readily appreciated that the top of the helmet 13 (comprised of the five lobe sections 12, 14, 16, 18 and 20), the air ring 40, and the base 80, when inflated through their respective air valves 30, 42 and 90, forming a three dimensional, cavity 41 and thus provides a head-wearable helmet which is snug to the head. The air within the components provides some modest amount of protection to the top of the head, in the event of an accident.

In a first preferred embodiment of the present invention, the top surface of the lobes is covered with a minimally elastic fabric or fabric like material which tends to thwart the deformation of the lobe(s) when in an accident. This seeks to maintain the air cushion between the point of impact and the head to minimize damage and injury to the head. The fabric can be a netting or complete sheet (except for the air vents or openings allowing breathing of the head for comfort) and preferably is made from a nylon, polyester, Cardura or similar fabric or material which will limit the expansion of elastomeric, air-filled lobes of the helmet, when subject to an outside force, due to an accident or crash.

Preferably, the embodiment just described is provided with a skull cap located in the cavity (secured therein or not) of the helmet or the cap is merely a separate component to be worn by the user. Preferably, the skull cap for this embodiment is a simple cotton netting with an elastic ring (or it could be inflatable, too) to allow the helmet to snuggly fit upon the size and shape of the wearer's head. Alternatively, this skull cap is made of the cotton netting or it can have one or more sections of foam or another elastomeric material to aid minimize the impact to the head of the helmet wearer, in the event of an accident or crash.

In alternate embodiment, the inside of the cavity of the helmet is lined with a thin layer of netting material (not shown in the drawings) so as to separate the top of the wearer's head from the bottom of the plastic lobes for comfort and air flow. The netting can be elastic and acts to minimize or eliminate the head of the wearer from sticking (due to moisture and humidity/sweating) to the plastic inside surfaces of the lobes.

In addition, the top of the helmet (the outer layer of the five lobes), with the base 80 and the rear contour lines forming three separated horizontal air tube portions, 91, 93, and 95, resemble, visually a conventional, head-protecting yet hard helmet for a cyclist or other activity enthusiast. However, this helmet is air inflatable and deflatable. When inflated, the helmet with its air chambers filled will fit over, around and snugly contour the head of a wearer, with the ring encircling and wrapping around the head of the cyclist and with the inside surfaces of the lobes resting upon the top of the wearer's head, extending from front to back and side to side. The base of the helmet, having a smaller diameter tubular section at the front of the helmet with that chamber increasing in diameter as the same extends to the sides of the helmet and rearwardly, and ending in the rear helmet section 80, with contour lines 46 and 48, defining subchambers 91, 93 and 95, physically and visually resembles a hard composition, head-protective bicycle helmet. However, significantly, one, two, or three (or more if provided) of the valves 30, 42 and 90 can be selectively opened, after initial inflation and closing of the valve for the helmet to be initially used, and air squeezed out from the interior of the chamber(s) to deflate the chambers so that the inventive helmet can be folded and/or compressed into a far smaller volume than the helmet provides when inflated. This allows the same to be easily transported in a small volume and, yet, the device can be re-inflated, when and where desired. When inflated, the device is a head protective helmet, filled with air; when deflated, the device can be folded or compressed (made devoid of air) so that the same can be stored in a pocket, knapsack, purse or briefcase, until desirably inflated for use.

According to the present invention, the thickness, when inflated, of the air inflatable chambers, lobes, the base is in the range of about % of an inch. When inflated, the pressure of air held within the chambers, lobes and base is preferably in the range of about 10 psi. For this reason, the helmet is likely only able to be properly inflated by use of a compressed source of air, a pump, cartridge, etc., and not merely by the use of one's lungs and their air blowing ability as the latter cannot approach the desired 10 psi.

Mere inflation of the helmet with air, provides some modest amount of protection to the wearer's head, in the event of an accident or unintended contact of head to a hard surface. However, as mentioned, the present invention, the seams and the plastic is designed for air filling to only about 10 psi of air and thus a head accident on the pavement or with most hard surfaces will result in a head injury. The material of the helmet could be made of tougher and stronger materials such that higher psi could be achieved and greater head protection by only the air compression of the helmet, but at the clear "expense" of weight, cost, comfort and surely ability to compact upon deflation.

The present invention, an air inflatable activity helmet is provided with a set of thin, preferably plastic straps extending down from the inside of the air ring 40. These plastic straps are quite similar in shape and extension to the straps now found on more conventional, hard plastic bicycle helmets to hold the helmet onto the wearer. Basically a pair of straps 101 and 103 are on each side of the helmet. The ends of the straps nearer to the inside of the air ring chamber 40 are sealed or otherwise secured thereto. Those two thin straps 101 and 103 form a Y-shape. One end of the top of the Y-shape is secured near the middle of the side of the helmet and the other end of the Y-shape is secured near the rear of the helmet. The common leg 105 of the Y-shape of the set of straps is secured to one half of a simple slide latch mechanism, quite conventional and common in other bicycle helmets. It is secured there by heat sealing, adhering, etc. This first half of the simple slide latch mechanism is the female half of the securing mechanism. As can be appreciated, the two legs of the Y-shape of each set of straps is dimensioned to extend around the wearer's ear when the helmet is inflated and placed upon the head. The other set of thin straps 101 and 103 is provided with the other half of the slide latch mechanism, the male half which is capable of being slide into and selectively released (by compressing resilient sides of the male tines of the male half). In the preferred embodiment, the male half of the slide latch mechanism is somewhat adjustable on the standing "leg" of the Y-shaped set of straps. The straps with the slide latch mechanism tend to hold the helmet down on the wearer's head, just like that of any helmet provided with straps on the sides about the ears and under/behind the chin. However, when the helmet is deflated, the straps can be used to wrap around the device, the latches connected together towards the top of the deflated helmet, to hold the same in a compact package. In the preferred embodiment, the deflated, folded and packaged size of the helmet is in the range of about 8 inches by 8 inches by about 2½ inches although other dimensions can be obtained, depending upon folding and compressing of the air out of the chambers.

In an alternative embodiment of the invention, the front of the inflatable helmet is provided with a stiff forwardly projecting visor. This will allow wind to press against it and the air in motion will tend to push the headwear downward, keeping it on the head and reducing the tendency of the helmet to be pulled off. This also tends to reduce the strain on the sets of straps which hold the helmet on the head, too.

In alternate embodiments of the present invention, the inside surface(s) of one or more of the lobes can be provided with foam, sponge-like material, or other "spacers" which can be selectively positioned to allow the user to configure the inside cavity to more closely correspond to the actual shape and size of head of the wearer.

In an alternative embodiment of the present invention, the inflatable helmet portion, comprising one or more lobes and/or an inflatable surrounding ring are contained within a hard exterior shell of plastic, ABS, PVC, Nylon or other suitable lightweight yet durable material. In this embodiment, the hard outside shell may still be foldable when the chambers of the inflatable portion of the helmet are deflated. Alternatively, as mentioned above, the outside or top of the helmet can be provided with a simple minimally elastic covering to minimize deformation of the air inflatable lobes during contact. In this embodiment of the invention, the air inflatable helmet described above can be housed in a minimally elastic or non-elastic, thin, lightweight sheet of material for constricting the expansion of the lobes, when inflated with air an subject to a crash.

In an alternate embodiment of the present invention, one or more of each of the lobes are formed from chambers one above the other in a superimposed manner so that a set of chambers is adjacent the wearer's head, another set separated from the first set and further including the possibility of one or more additional sets of chambers located above the second and successive sets. The subsets of inflatable lobes can be the same thickness when inflated or increasing in thickness as the sublobes extend away or towards the wearer's head.

Towards the desired goal of providing a truly head injury protective helmet and to providing a helmet that will "pass" the tests for such by the Consumer Product Safety Commission, the present invention also provides an impact absorbing piece of material, preferably in the shape of a skull cap. This can be a separate component or can be integrated into the cavity of the helmet, secured to the top, but beneath the inelastic layer of material, atop the inelastic material or even within the air envelope of the lobes. The skull cap can be a simple cotton netting and/or provided with foam.

Figure 10:
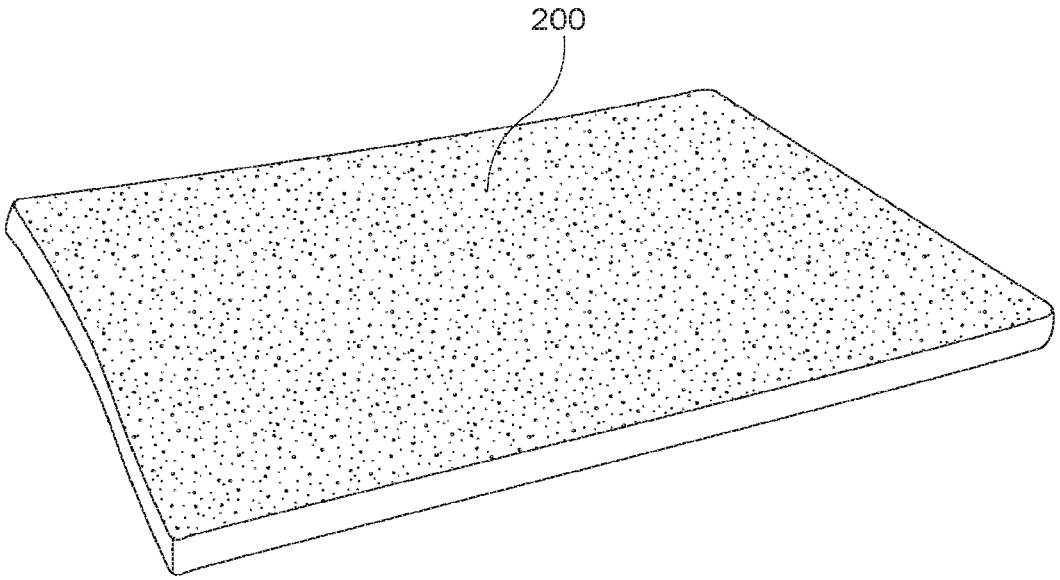
FIG. 10 is a top side perspective view of a sample of the gel material which will be shaped into a skull cap and preferably integrated into the inflatable helmet for head protection. Preferably, as will be described, the skull cap is within the cavity of the helmet and/or in the air chamber(s) between the air inflatable layers forming the lobes of the helmet and is in the range of about ¼ of an inch in thickness to absorb the forces of a head crash and, yet, for the same to be foldable into a small volume when the helmet is deflated and desirably folded into a small package for toting.

In another embodiment of the invention, the skull cap is preferably a flexible gel which will absorb and dissipate the expected forces of impact in the event of an accident. The flexible gel is preferably in the shape of a skull cap and can be placed on the wearer's head before the inflatable helmet is donned. The skull cap, with a concave side facing the wearer's convex shaped head, and having a convex side of the skull cap fitting into the concave side or cavity of the helmet, will provide significant protection to the head. The protective gel 200 (see FIG. 10) if formed into a skull cap shape (not shown) will, when subjected to impact forces, dissipate the same across its material and not allow the full force of the impact to directly impact on the wearer's head. The force absorbing ability of the flexible gel is highly beneficial to the inflatable helmet serving as a head protective device. The flexible gel 200 is somewhat foldable, too, so it, too, can assume, when folded and compressed, a smaller volume for ease of carrying and toting. And, the flexible gel is lightweight so that it will not make the combination of inflatable helmet and flexible gel, both impact absorbing components, unwieldly and heavy nor bulky. The flexible gel 200 will act in a manner similar to that of a sheet of Kevlar® material in that it will absorb and dissipate the forces of the impact rather than allowing the same to pass directly therethrough.

According to the currently preferred embodiment of the present invention, the flexible gel material can be about ¼ of an inch in thickness and a preferred materials for the same is currently available from www.impactgel.com, IG Holdings. Among the listed usages of the flexible gel material is bicycle seats, motorcycle seat inserts, smart phone cases, insoles for footwear, etc. It is believed that a sample of the flexible gel which can be employed to great advantage in terms of flexibility, weight and impact resistance, is referred to as D-30 type.

According to the preferred embodiment, the flexible gel will be held within and between the layers of the plastic lobes. In an alternate embodiment, the plastic lobes can be provided with an opening, in addition to the valves which allows for the flexible gel, in a sheet, to be slid into the chambers of the lobes i.e., between the inside and outside layer of the lobes and then sealed therein, by a seal of the type used for plastic and reusable food storage bags. In this manner the flexible gel sheets can be selectively removed and inserted and even replaced as desired or required. In any event, the preferred embodiment provides the sheet of flexible gel, whether as a separate skull cap held within the cavity of the helmet, a sheet or sheets of material held within the envelope of the lobes, or even on top of the outside of the lobes, as a highly effective force absorbing material, capable of minimizing injury in the event of a head collision/accident.

In the embodiment of the invention wherein the flexible gel sheet is held on the top of the helmet, it can be held there by suitable fasteners or can be held thereon by a simple and lightweight netting surrounding the outside surface of the lobes of the helmet. Here, too, the flexible gel can be removed and replaced, as desired or required. Also, the ability to remove and alternatively hold the flexible gel sheet separate from the helmet allows for increased options in the storage and transportation of the protective helmet components, until needed for use.

It is believed that the flexible gel material will be flexible in normal use but stiffen up into a solid upon impact over a larger are than that of the impact to reduce focal points of pressure, thereby lowering the g force of the impact to the wearer.

While certain embodiments and details have been included herein and in the attached invention disclosure for purposes of illustrating the invention, it will be apparent to those of skill in the art that various changes in the methods and apparatuses disclosed herein may be made without departing from the scope of the invention, which is defined in the appended claims.

I claim:

1. A safety helmet comprising:

a. a head-conforming enclosure comprised of one or more air inflatable lobes together defining an interiorly directed, head holding hemi-spherical-like cavity and an exterior helmet-like outer surface, at least one of said lobes having an air inflation/deflation valve, said lobes substantially conforming and surrounding, when inflated, a wearer's head so that it extends downwardly to at least just above the ears; and b. a skull cap of impact absorbing and dissipating material disposed within said head holding hemi-spherical-like cavity formed by the air inflatable lobes, wherein the one or more air inflatable lobes are capable of deflation and collapsing to permit folding or compacting of the safety helmet including an exterior surface of the safety helmet into a smaller volume than when inflated.

2. A safety helmet as claimed in claim 1 wherein said head holding hemi-spherical-like cavity is further formed and lined with a gel, flexible gel, a semi liquid, a liquid or combinations thereof.

3. A safety helmet as claimed in claim 1 wherein said cavity is further provided with a shape-conforming inflatable element, which, when inflated and worn, conforms to the shape and size of the head to be contained within said cavity.

4. A safety helmet as claimed in claim 1 wherein said skull cap is integrated with and held by said head holding cavity.

5. A safety helmet as claimed in claim 4 wherein said skull cap is removable from and replaceable into said enclosure defined by said lobes.

6. A safety helmet as claimed in claim 1 further comprising a forwardly projecting visor.

7. A safety helmet as claimed in claim 1 wherein when fully deflated, the same can be compacted and stored into a size of about 8 inches by 8 inches by 2½ inches.

8. A safety helmet consisting essentially of:

a. a head-conforming enclosure comprised of one or more air inflatable lobes together defining an interiorly directed, head holding hemi-spherical-like cavity and an exterior helmet-like outer surface, the exterior helmet-like outer surface of the one or more air inflatable lobes being soft and flexible when not inflated and comprising an exterior surface of the safety helmet, and at least one of said lobes having an air inflation/deflation valve, said lobes substantially conforming and surrounding, when inflated, a wearer's head so that it extends downwardly to at least just above the ears; and b. a skull cap of impact absorbing and dissipating material disposed within said head holding hemi-spherical-like cavity formed by the air inflatable lobes.

9. A safety helmet as claimed in claim 8 wherein said head holding hemi-spherical-like is further formed and lined with a gel, flexible gel, a semi liquid, a liquid or combinations thereof.

10. A safety helmet as claimed in claim 8 wherein said cavity is further provided with a shape-conforming inflatable element, which, when inflated and worn, conforms to the shape and size of the head to be contained within said cavity.

11. A safety helmet as claimed in claim 8 wherein said skull cap is integrated with and held by said head holding cavity.

12. A safety helmet as claimed in claim 11 wherein said skull cap is removable from and replaceable into said enclosure defined by said lobes.

13. A safety helmet as claimed in claim 8 further comprising a forwardly projecting visor.

14. A safety helmet as claimed in claim 8 wherein when fully deflated, the same can be compacted and stored into a size of about 8 inches by 8 inches by 2½ inches.

* * * * *